US009314386B1

(12) United States Patent
Boyd

(10) Patent No.: US 9,314,386 B1
(45) Date of Patent: Apr. 19, 2016

(54) FOLDING BED FRAME

(76) Inventor: Dennis Boyd, Town and Country, MO (US)

( * ) Notice: Subject to any disclaimer, the term of this patent is extended or adjusted under 35 U.S.C. 154(b) by 273 days.

(21) Appl. No.: 13/339,119

(22) Filed: Dec. 28, 2011

Related U.S. Application Data

(63) Continuation-in-part of application No. 12/861,537, filed on Aug. 23, 2010, now abandoned.

(51) Int. Cl.
*A47C 19/00* (2006.01)
*A61G 7/015* (2006.01)

(52) U.S. Cl.
CPC ..... *A61G 7/015* (2013.01)

(58) Field of Classification Search
CPC ..... A61G 7/015; A47C 20/027; A47C 20/043
USPC ..... 5/617, 633, 634
See application file for complete search history.

(56) References Cited

U.S. PATENT DOCUMENTS 256,176 A * 4/1882 Turk ..... 5/617
585,646 A * 7/1897 Ames ..... 5/604
972,537 A * 10/1910 Jeffcott ..... 5/617
2,430,662 A * 11/1947 Barton ..... 280/32.6
4,780,919 A * 11/1988 Harrison ..... 5/600
5,829,075 A * 11/1998 Stewart, Jr. ..... 5/202
7,082,882 B2 * 8/2006 Heimbrock ..... 108/49
7,600,278 B2 10/2009 Oh
2005/0257319 A1 * 11/2005 Ikeda et al. ..... 5/618
2007/0277317 A1 * 12/2007 Ferko ..... 5/620
2009/0193583 A1 * 8/2009 Lee et al. ..... 5/176.1
2011/0162144 A1 * 7/2011 Kanthasamy ..... 5/617

* cited by examiner

*Primary Examiner* — Timothy D Collins
*Assistant Examiner* — Richard G Davis
(74) *Attorney, Agent, or Firm* — Husch Blackwell LLP

(57) ABSTRACT

An adjustable platform bed frame includes first and second frame segments, wherein each frame segment has an outer frame member and a plurality of cross-members, with the first frame segment being positioned at a height that is slightly lower than that of the second frame segment; an adjustable frame member pivotally connected with and positioned above the first frame segment; and an adjustment mechanism connected at one end with the first frame segment and at its other end with the adjustable frame member, with the adjustment mechanism being operable for temporarily fixing the adjustable frame member in an inclined position relative to the second frame segment. The first and second frame segments may also be connected with one another by a lateral hinge connection that allows the first and second frame segments to fold relative to one another.

20 Claims, 12 Drawing Sheets

FOLDING BED FRAME

CROSS REFERENCE

This application is a continuation-in-part of and claims priority to co-pending U.S. patent application Ser. No. 12/861,537, filed on Aug. 23, 2010.

TECHNICAL FIELD OF THE INVENTION

The present invention relates generally to the field of bedding products and, more particularly, to an improved support structure for a mattress.

BACKGROUND OF THE INVENTION

Platform type bed frames have been used for several years as an alternative to standard bed frames that lie closer to the floor and are designed with relatively open framing to accommodate a mattress foundation as well as a mattress. In contrast, platform bed frames are typically raised a greater distance from the floor, for example ten to fourteen inches, which allows for underbed storage. Platform bed frames are also typically provided with a horizontal framework that is specifically designed to fully support a mattress without the need for a foundation. An example of a known platform bed frame is described in U.S. Pat. No. 7,600,278. The platform bed frame described in the '278 patent has the added benefit of having a folding design. More specifically, the bed frame is divided in half with the resulting frame portions being connected at the midpoint of the frame by a hinge connection.

However, platform bed frames of the type described in the '278 patent (illustrated in FIG. 1) have a number of drawbacks of significance. First, the folding design utilized in these frames requires a structurally complex middle hinge that is relatively expensive. Further, the prior art platform bed frames have a relatively limited weight capacity that can create issues for larger customers. Finally, while these prior art frames do fold, they still require larger packaging and are difficult to place on to standard store display shelves.

In addition, when used in combination to support larger mattresses, the known prior art platform bed frames provide insufficient support for the middle of the mattress, which can result in sagging of the mattress, especially in the case of foam mattresses or lower profile innerspring mattresses. In particular, the prior art frames utilize connecting bars to connect two frames together, which allows the mattress to sag between the connecting bars.

Additionally, prior art platform bed frames have been limited to flat usage even though there is a demonstrated market need for bed frames in all categories that are adjustable. In the case of platform bed frames, and more particularly, folding platform bed frames, the required hinges to render the frames foldable creates a significant obstacle to also incorporating portions of the frame (e.g., the head or foot portion) that can be raised by the user to accommodate various medical issues or to improve comfort of the user during certain activities such as reading or watching television while using the bed.

While there are bedding systems that incorporate adjustable portions, these prior art frames incorporate motors and electric controls to raise and lower different portions of the mattress. These systems cost thousands of dollars and are difficult to setup. They must be delivered by a dedicated delivery team. They cannot be shipped by UPS or FedEx directly to the user or setup by the average user. They are difficult to move after setup, for example, if the owner would like to move the frame to another room in the house or moves to a different house altogether. They are also somewhat complicated to use and require specialized maintenance.

Therefore, it would be advantageous to provide an improved platform bed frame having greater structural rigidity and weight capacity while being foldable into a smaller footprint to enhance packaging and display qualities. It would also be desirable to provide a platform bed frame that incorporates adjustable portions in a manner that maintains a lightweight, shippable, easy to setup and use frame.

SUMMARY OF THE INVENTION

One aspect of the invention generally pertains to an improved platform bed frame having increased structural rigidity, both when used alone and when multiple bed frames are combined to accommodate larger mattresses.

Another aspect of the invention pertains to an improved platform bed frame having an increased weight carrying capacity.

Yet another aspect of the invention is to provide a platform bed frame capable of being folded into a smaller footprint.

Another aspect of the invention generally pertains to an improved platform bed frame having one or more adjustable portions allowing those portions to be inclined relative to other portions of the frame.

In accordance with the above aspects of the invention, there is provided an adjustable platform bed frame that includes first and second frame segments, wherein each frame segment has an outer frame member and a plurality of cross-members, with the first frame segment being positioned at a height that is slightly lower than that of the second frame segment; an adjustable frame member pivotally connected with and positioned above the first frame segment; and an adjustment mechanism connected at one end with the first frame segment and at its other end with the adjustable frame member, with the adjustment mechanism being operable for temporarily fixing the adjustable frame member in an inclined position relative to the first frame segment. The first and second frame segments may also be connected with one another by a lateral hinge connection that allows the first and second frame segments to fold relative to one another.

An associated method of supporting a mattress with a platform bed frame is also provided that includes the steps of (a) providing an adjustable platform bed that includes first and second frame segments, wherein the frame segments each have an outer frame member and a plurality of cross-members, the first frame segment being positioned at a height that is slightly lower than that of the second frame segment; an adjustable frame member pivotally connected with and positioned above the first frame segment; and an adjustment mechanism connected at one end with the first frame segment and at its other end with the adjustable frame member, the adjustment mechanism being operable for temporarily fixing the adjustable frame member in an inclined position relative to the second frame segment; (b) placing a mattress on the first and second frame segments; and (c) raising the adjustable frame member to a desired incline level relative to the second frame segment.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION

Figure 1:
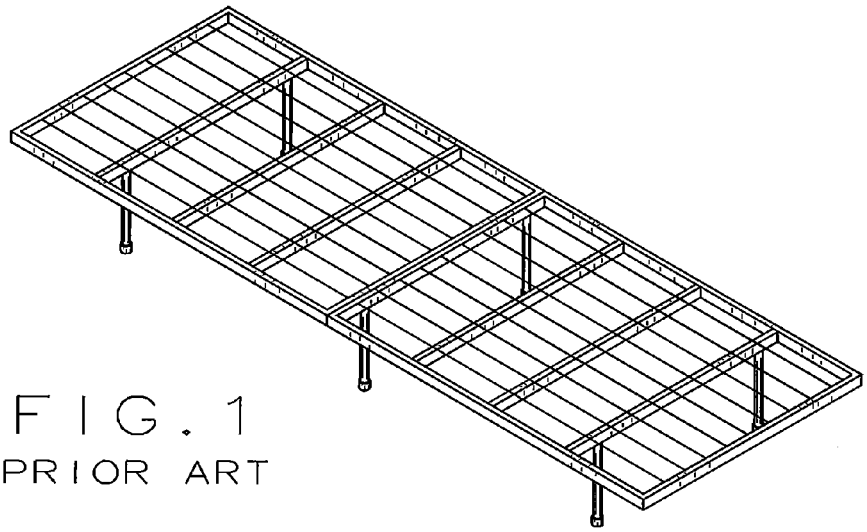
FIG. 1 PRIOR ART
FIG. 1 is a perspective view of a prior art platform bed frame.
Figure 2:
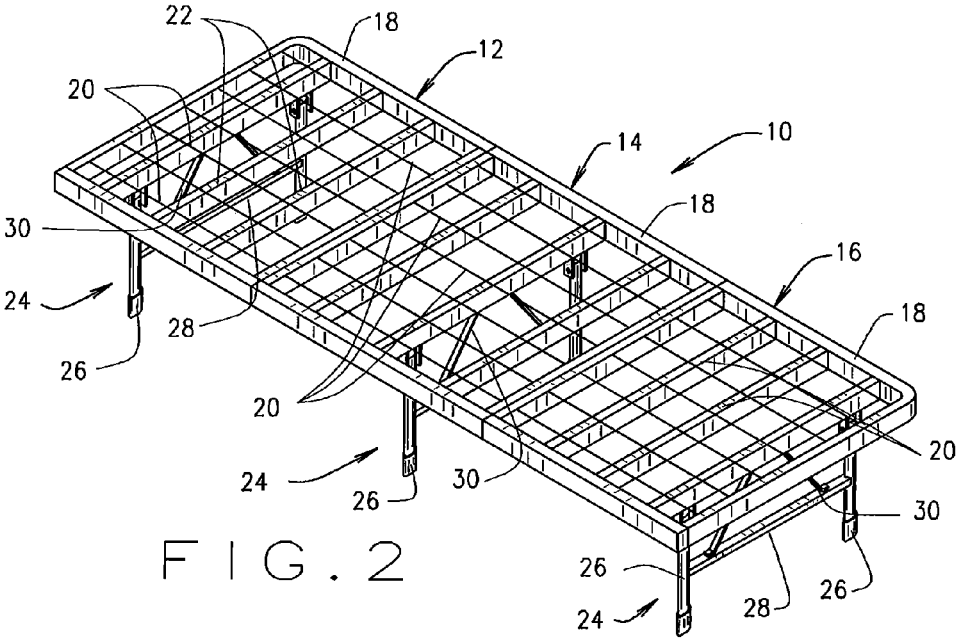
FIG. 2 is a perspective view of a platform bed frame in its unfolded position according to a first embodiment of the present invention.
Figure 3:
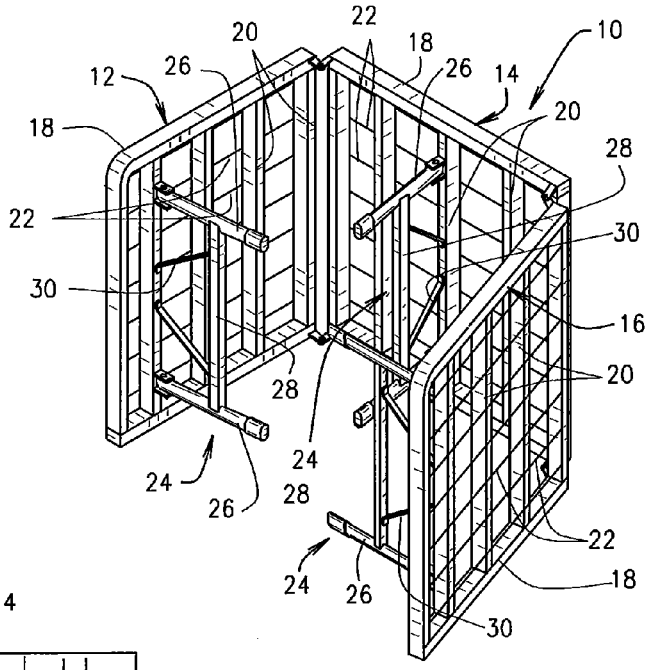
FIG. 3 is a perspective view of the platform bed frame of FIG. 2 in its folded position.
Figure 4:
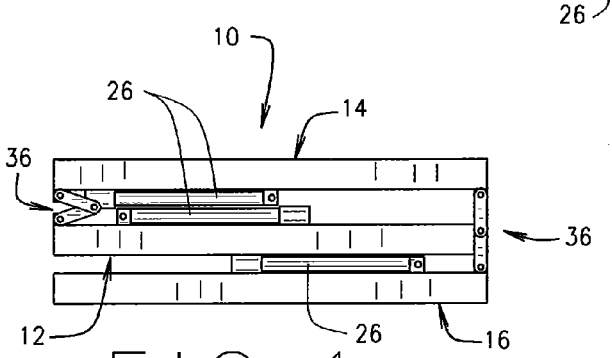
FIG. 4 is a side view of the platform bed frame of FIG. 2 in a partially folded position.

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

FIGS. 2-6 illustrate an improved folding bed frame 10 according to one embodiment of the present invention. The folding bed frame 10 includes a series of three frame segments 12, 14, 16. Each frame segment is composed of an outer frame member 18 and multiple cross-members 20. The outer frame member 18 of each frame segment may be manufactured from a single piece of material, for example, steel, aluminum, or other suitable and well known materials, that is bent or otherwise formed into a generally rectangular shape. Alternately, separate pieces of material may be combined, for example by welding, to form the desired shape for each frame segment.

In a preferred embodiment, the outer frame member 18 of the various frame segments 12, 14, 16 differ slightly in their shape. For example, the distal ends of the outer frame segments 12, 16 may be provided with one or more rounded corners. These rounded corners generally match the peripheral shape of the mattress resting on the bed frame 10 and minimize protrusion of any portion of the bed frame beyond the mattress edge. In the case of bed frames 10 that are intended for use in multiple sets, as discussed in more detail below, only the outer, distal corners of the outer frame segments 12, 16 are rounded as the inner, distal corners will typically lie adjacent a matching frame 10 and be positioned underneath the mid portion of the mattress. In either case, the middle frame segment 14 will generally have square corners.

The cross-members 20 for each frame segment 12, 14, 16 are linear pieces of material, in most cases the same material used for the outer frame member 18, that are attached to the outer frame member 18. In the illustrated embodiment, the cross-members 20 are welded to the outer frame member 18, although those of skill in the art will recognize that any number of other connecting methods can be used. The cross-members 20 serve at least two purposes. First, they provide increased rigidity to the frame segment. Second, combined with the other cross-members 20 of the bed frame 10, they form the primary components of the platform that supports a mattress placed on the bed frame 10

The frame segments 12, 14, 16 may be further supported by multiple elongated support members 22. These elongated support members 22 combine with the cross-members 20 to provide additional support to a mattress on the frame. In the illustrated embodiment, the elongated support members 22 are narrow diameter bars that extend from one end of each frame segment to the other. These support members 22 are connected at each end to the outer frame member 18. The elongated support members 22 may be welded to the outer frame member 18. In other embodiments, the elongated support members 22 may be provided with threaded end sections that are threaded into mating threaded holes in the outer frame member 18. Those of skill in the art will readily recognize that a variety of connecting methods are suitable for attaching the elongated support members 22 to the outer frame member 18. In addition, to further increase the rigidity of the structure, the elongated support members 22 may also be connected to one or more of the cross-members 20 by any known means.

At least the outer frame segments 12, 16 are provided with folding leg assemblies 24. In the illustrated embodiment, these leg assemblies include two legs 26 and a leg assembly support beam 28. The leg assembly support beam 28 is connected to each of the legs 26 in a secure manner, for example by bolts, screws, welds, or similar means. In a preferred embodiment, the leg assemblies 24 also include one or more angled support brackets 30. The angled support brackets 30 are connected at one end thereof to the support beam 28 or the legs 26 and at the other end to the frame segment. In alternate embodiments, the leg assemblies 24 may only include legs 26 that are connected by hinges, as discussed below, to their respective frame segment.

The leg assembly 24 is hingedly connected to the frame segment 12, 16. In the illustrated embodiment, a hinge connection 32 is provided at the top of each leg 26 to facilitate a pivoting connection between the leg 26 and one of the cross-members 20 of the frame segment 12, 16. Similarly, where support brackets 30 are utilized, a hinge connection 34 may also be provided at the connection of the bracket 30 and frame segment 12, 16. While the leg assembly 24 is connected to one of the cross-members 20 rather than to the outer frame member 18, the latter arrangement is contemplated within the scope of the present invention. For additional structural support, a third leg assembly 24 of similar structure may be provided for the middle frame segment 14.

Each frame segment 12, 14, 16 is attached to its adjacent frame segment by a lateral hinge connection 36. The hinge connection may take many forms. In the illustrated embodiment, the hinge connection 36 comprises two hinges 38 connected with the outer frame members 18 of two adjacent frame segments. More specifically, in each hinge, first 40 and second 42 flanges are pivotally connected to the outer frame members 18 of the adjacent frame segments, respectively. In turn the first 40 and second 42 flanges are pivotally connected to one another. This simplified hinge arrangement is duplicated in the other hinge connection 36. Each hinge connection 36 is oriented perpendicular to the length of the bed frame 10 and runs parallel to, and is offset from, a lateral midline 44 of the frame 10. In the preferred embodiments, one of the hinge connections is located to one side, and at a spaced distance from, the midline 44 while the other hinge connection is located on the opposite side, and again spaced a distance from, the midline 44.

Figure 7:
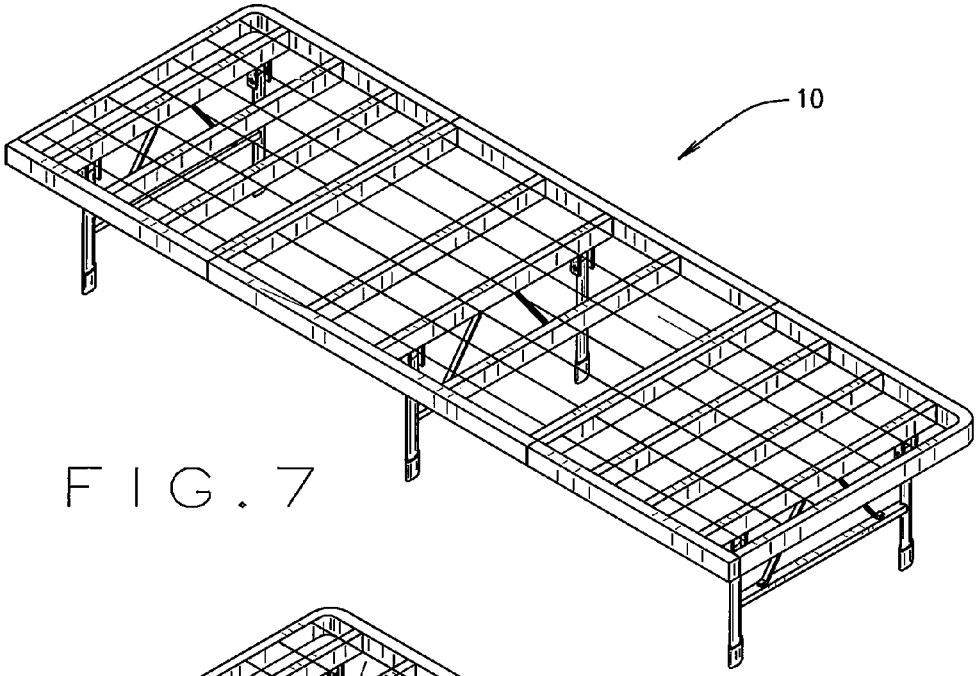
FIG. 7 is a perspective view of a platform frame according to another embodiment.

In the embodiment illustrated in FIGS. 2-6, each frame segment 12, 14, 16 is provided with similar length and width dimensions, thereby effectively making each frame segment generally one-third of the overall dimensions of the bed frame 10. However, as can be seen in the illustration of an alternate embodiment in FIG. 7, it is possible to make the middle frame segment longer than the outer frame segments, and more particularly, equal to the combined length of the outer frame segments.

Figure 9:
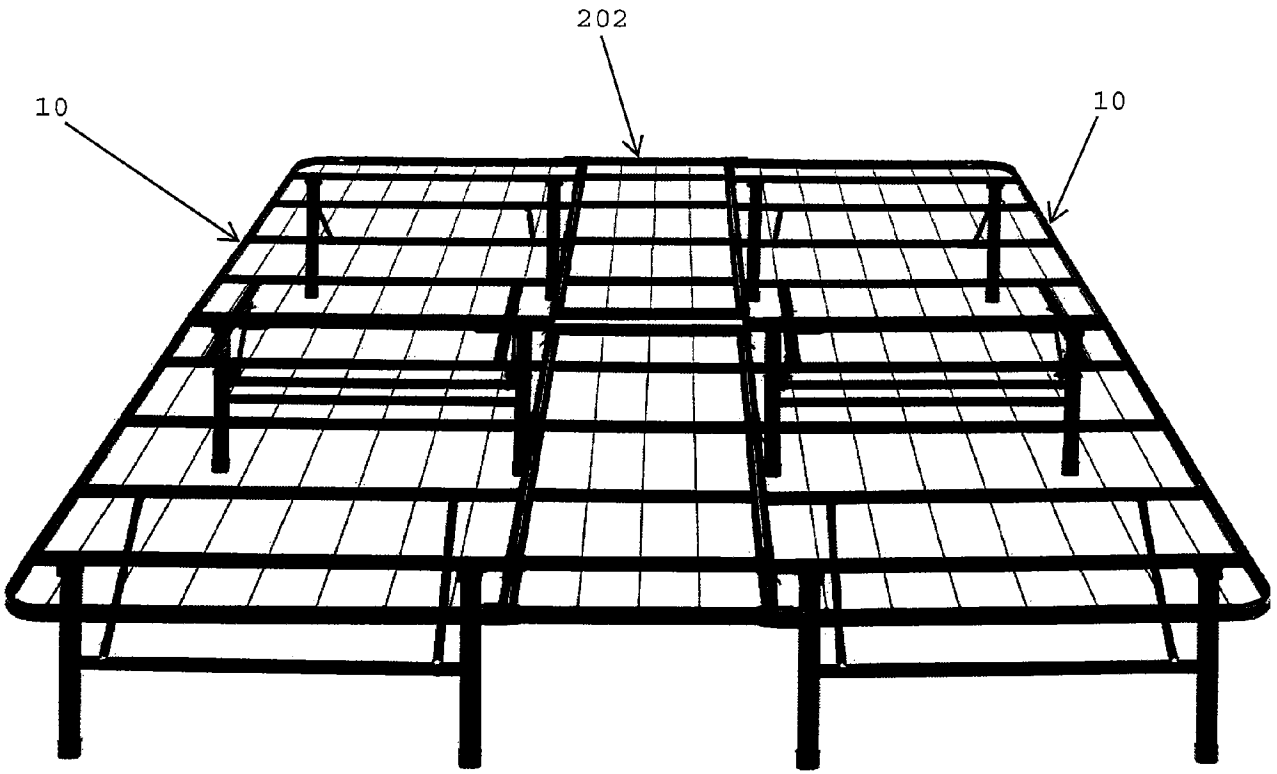
FIG. 9 is a perspective view of a platform frame according to another embodiment in which two frames are combined to accommodate larger mattress sizes.
Figure 10:
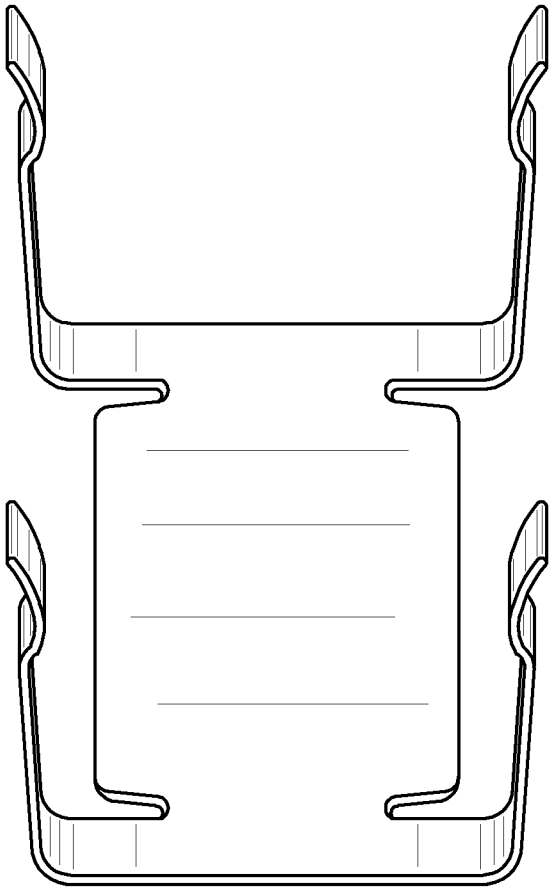
FIG. 10 is an illustration of clips suitable for use with various embodiments.

It is contemplated that pairs of bed frames 10 may be used in combination to accommodate mattresses of larger size. For example, a single bed frame 10 may be provided with overall length and width dimensions to accommodate a twin size mattress or a twin extra-long mattress. Two such frames can be combined to accommodate a king size mattress. Clips 200, as shown in FIG. 10, may be used to secure the two frames together and prevent the frames from being slid apart until desired. The clips 200 are generally U-shaped and are arranged to fit around both of the outer frame members 18 of adjacent frame segments of the bed frames. Furthermore, connecting frame segments 202 may be added to such combinations of bed frames to accommodate even larger mattresses. An example of such an arrangement is illustrated in FIG. 9. The connecting frame segments 202 are advantageously formed by grids of a similar structure to the grids employed in frame segments 12, 14, 16. This arrangement results in a more structurally sound connection of the bed frames. Further, the fact that the connecting frame segments extend all the way to the ends of the outer frame segments 12, 16 enhances the appearance of the combination and eliminates indenting of any frame covers or bed skirts that may be used with the bed frames.

Figure 8:
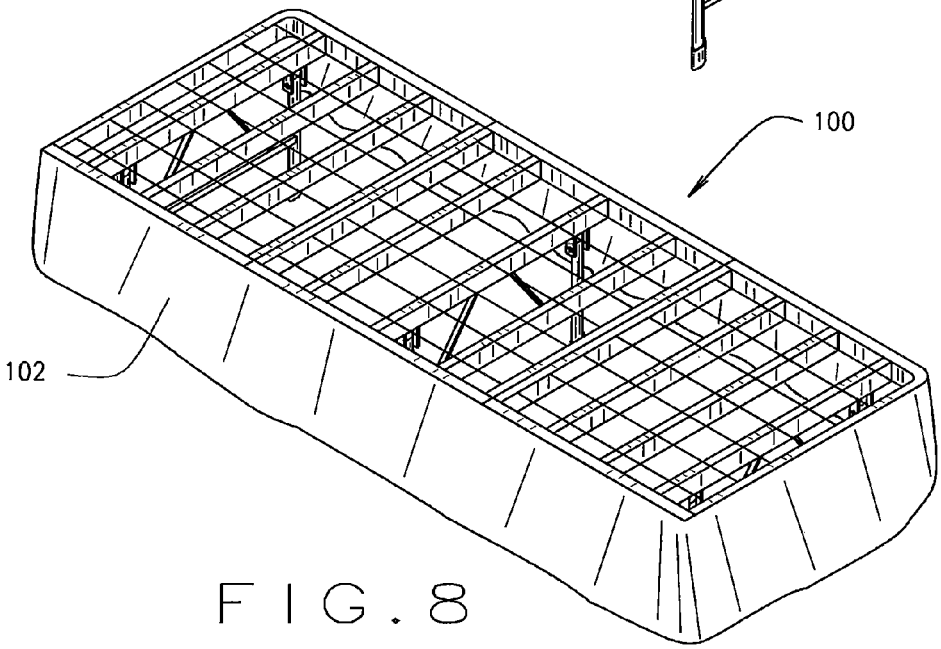
FIG. 8 is a perspective view of a platform frame according to another embodiment in which a cover is a positioned around the frame to emulate a foundation.

FIG. 8 illustrates a folding bed frame 10 incorporating a cover 102 that extends around the perimeter of the bed frame. The cover 102 may be fitted to the perimeter dimensions of the bed frame 102 so that it fits snugly to the frame 10. In should be noted that the rounded outside corners and squared inside corners of the outer frame segments 12, 16 as discussed above eliminate indenting of the cover 102, or for that matter bed skirts that may be used with the bed frame, at the foot of the bed frame, thereby enhancing the aesthetic performance of the bed frame. The fit of the cover 102 or a bed skirt may be further enhanced through the use of plastic flanges that clip onto the outer frame members 18 of the frame segments of the bed frame 10 in the corners and in the middle of the frame between the corners. The fit of the cover 102 may be enhanced with the incorporation of elastic bands to facilitate the desired close fit. Further, the cover 102 may be a continuous sheet that slips over the frame 100 or have an opening to allow the cover to be wrapped around the frame. The opening may be closed with hook and loop fabric fasteners attached to the ends of the cover. FIG. 8 illustrates a cover 102 arranged about a single frame. Where multiple bed frames 10 are combined as discussed above, it is possible to utilize individual covers 102 on each frame or to provide a larger cover sized to accommodate the combined frames and present a unitary appearance that disguises the fact that multiple bed frames have been used.

Figure 11:
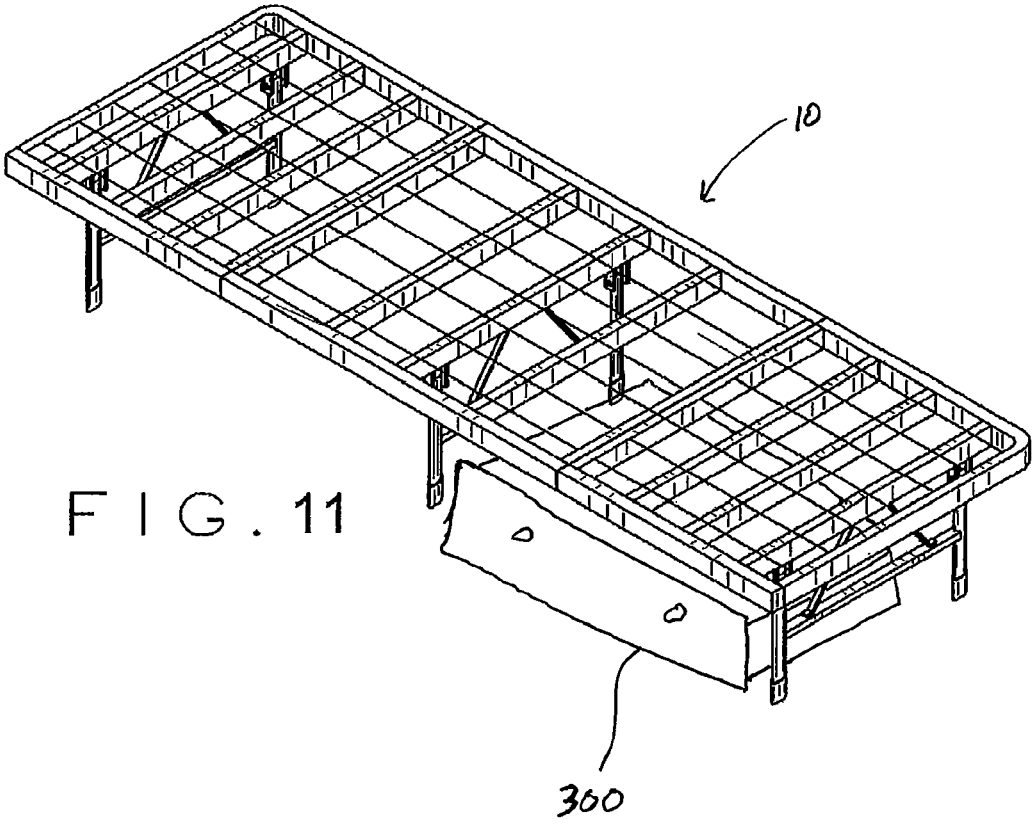
FIG. 11 is an illustration of a platform frame incorporating underframe drawers according to another embodiment.

The structure of the bed frames of the present invention provides ideal space for additional, underbed storage. This feature can be further enhanced through the use of drawers 300 positioned underneath the bed frame(s) as illustrated in FIG. 11. Drawers 300 roll or slide in and out of position underneath the bed frame. In a preferred embodiment, rolling drawers 300 are sold separately and unassembled so that they may be easily shipped to the purchaser.

It is notable that various commercial embodiments of the present invention have unexpectedly resulted in significantly improved performance characteristics. One of the single most important quantifiable performance measurements of platform type bed frames is their load capacity. Typical prior art platform bed frames have been found to have a maximum capacity of approximately 2,500 lbs. In contrast, commercial embodiments of the present invention, utilizing the same basic raw materials, e.g., the same gauge steel tubing, same grade of steel or other materials, etc., exhibit a capacity of at least 4,000 lbs., which is clearly an enormous increase and results in a far sturdier and more supportive bed frame than has been previously seen.

In addition to the increased capacity, the tri-fold design provides for easier packaging and store display of bed frames. These frames can be packaged in a smaller, shorter box, which reduces packaging costs, that is easier to fit onto standard store display shelves.

FIGS. 12-17 illustrate a platform bed frame 400 having at least one adjustable section. More particularly, the adjustable section may be inclined relative to one or more other sections of the frame 400 or lowered to lie in the same plane as the other sections of the frame 400. In the figures, two frames 400 are shown arranged side by side to support a single mattress.

The platform bed frame 400 may be manufactured in either folding or non-folding versions. The embodiment illustrated in FIGS. 12-17 represents a folding version. More particularly, this embodiment utilizes a tri-fold design that is very similar to the embodiments described above. Therefore, those parts of the embodiment of FIGS. 12-17 utilize the same reference numerals for parts that corresponding to those in the above embodiments with the addition of a "4" before the reference numeral. The tri-fold design is particularly advantageous in combination with the adjustable section as the hinges used in the tri-fold design help divide the frame into head, middle and foot portions with the head and/or foot portions being adjustable relative to the middle portion of the frame.

Figure 12:
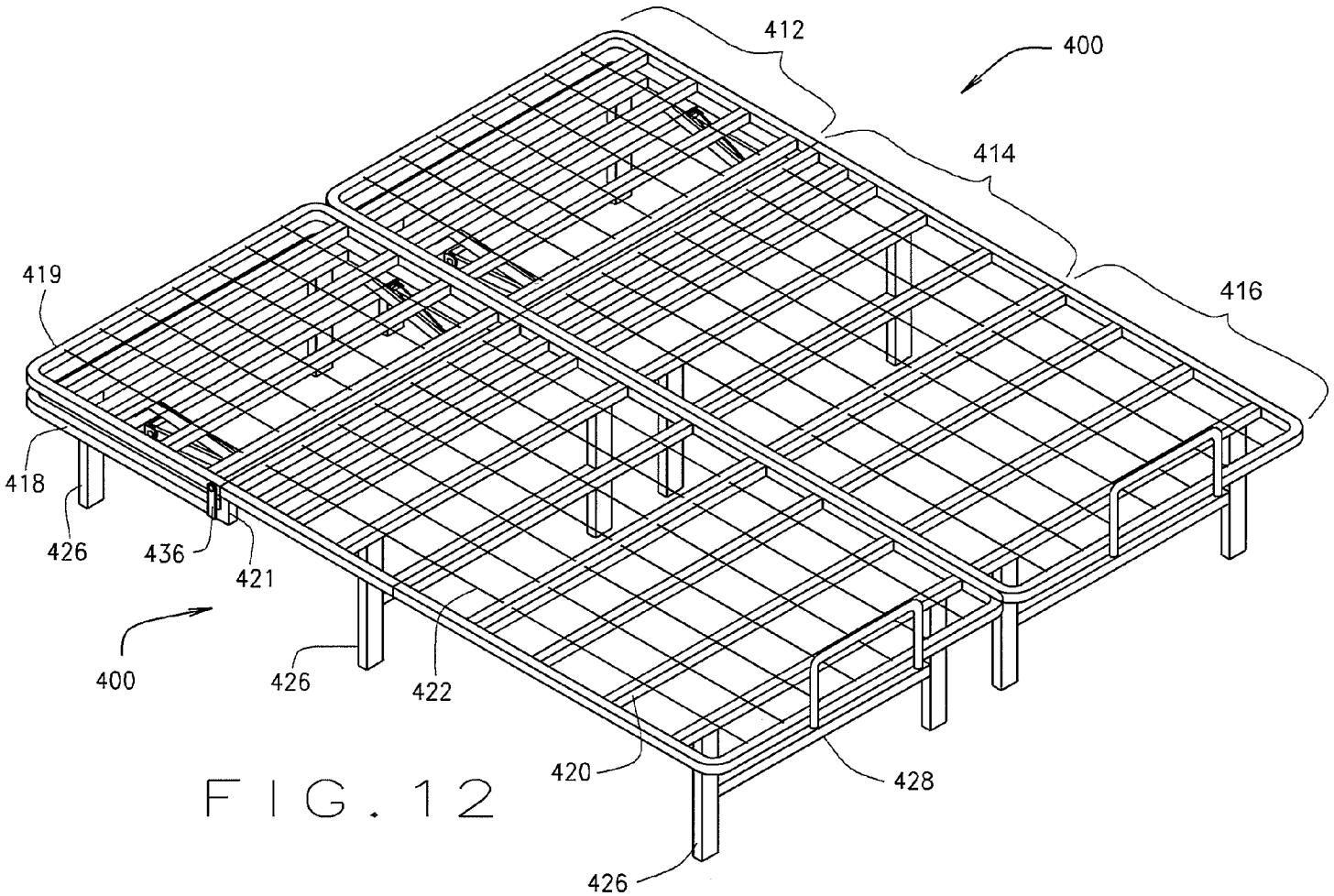
FIG. 12 is a perspective view of a pair of adjustable platform bed frames in their flat position according to another embodiment.
Figure 13:
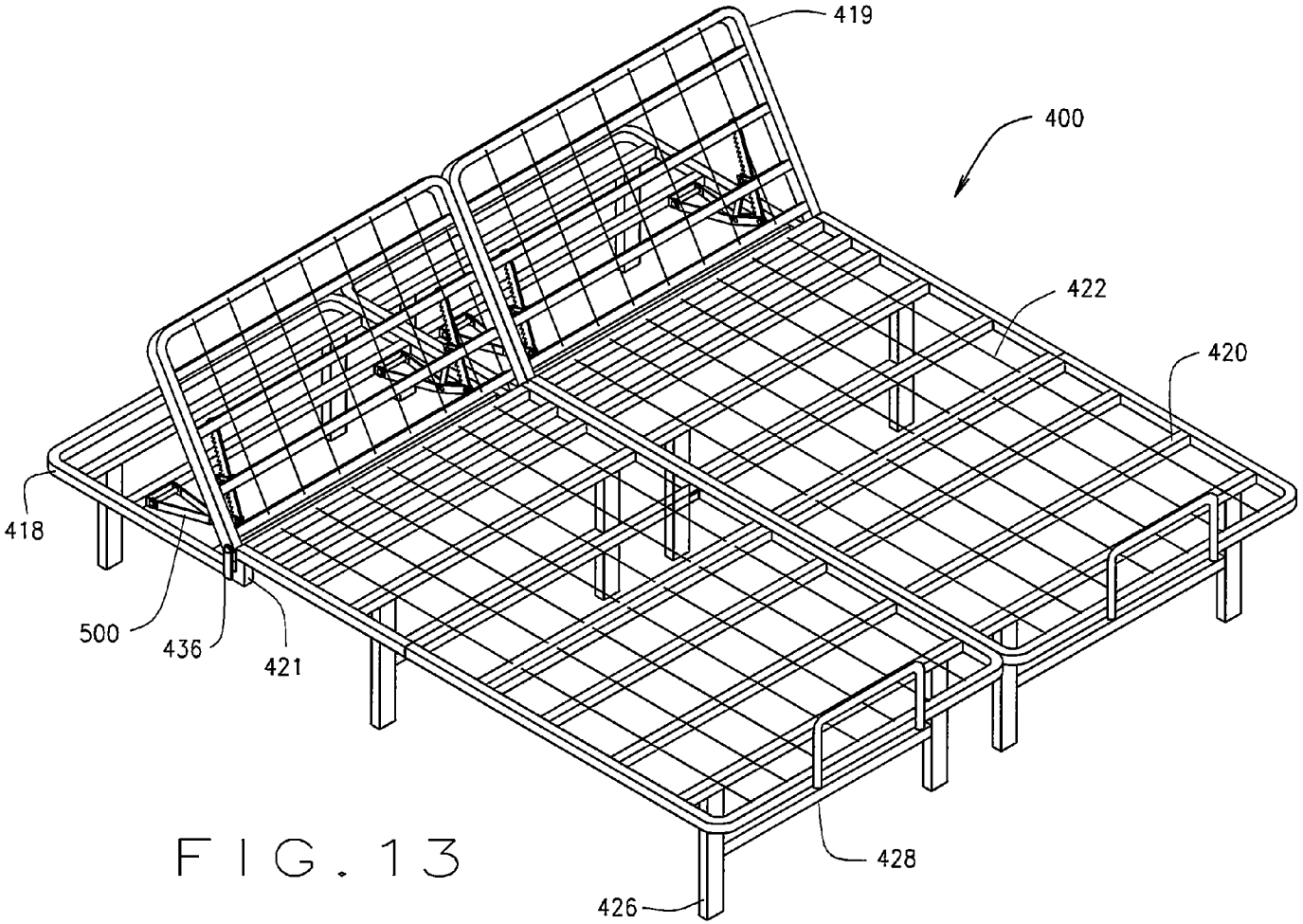
FIG. 13 is a perspective view of the adjustable platform bed frames of FIG. 12 in an inclined position.
Figure 14:
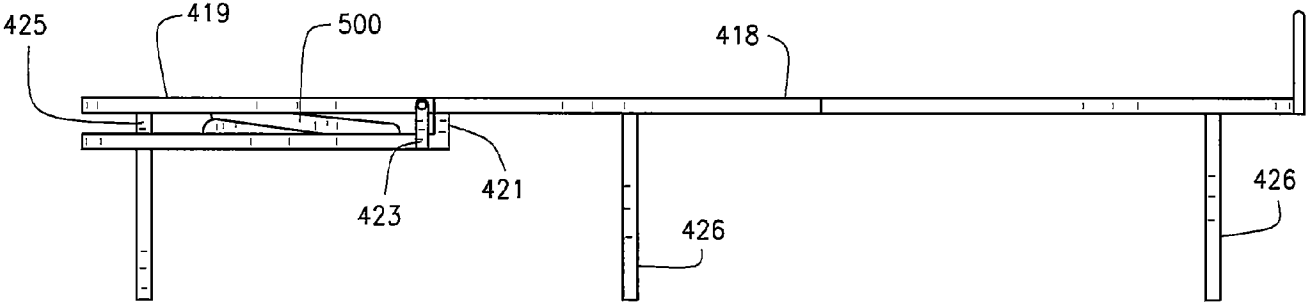
FIG. 14 is a side view of an adjustable platform bed frame hi its flat position.
Figure 15:
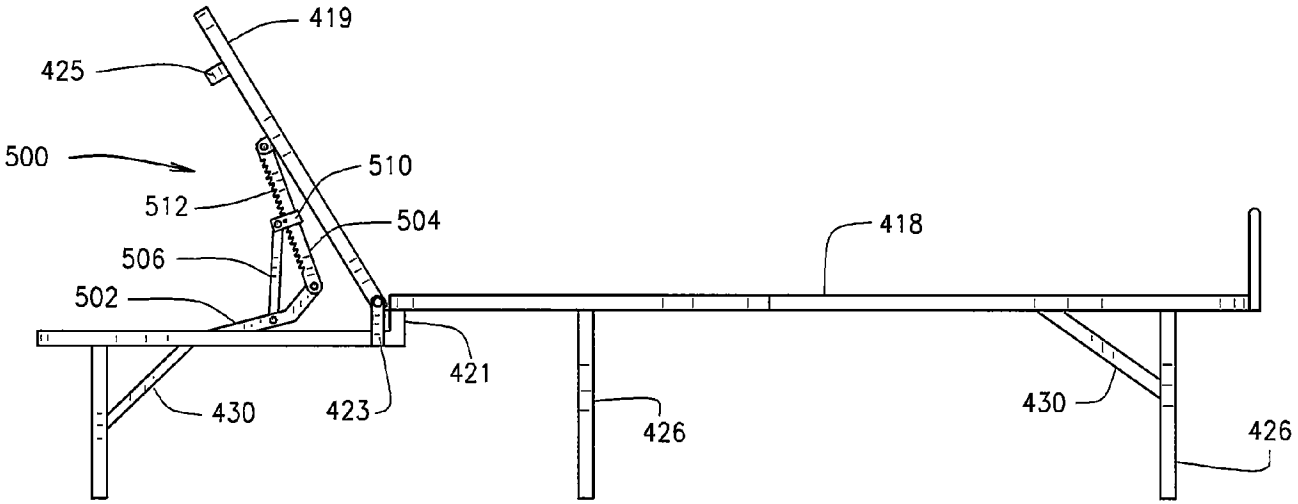
FIG. 15 is a side of the adjustable platform bed frame of FIG. 14 in an inclined position.
Figure 16:
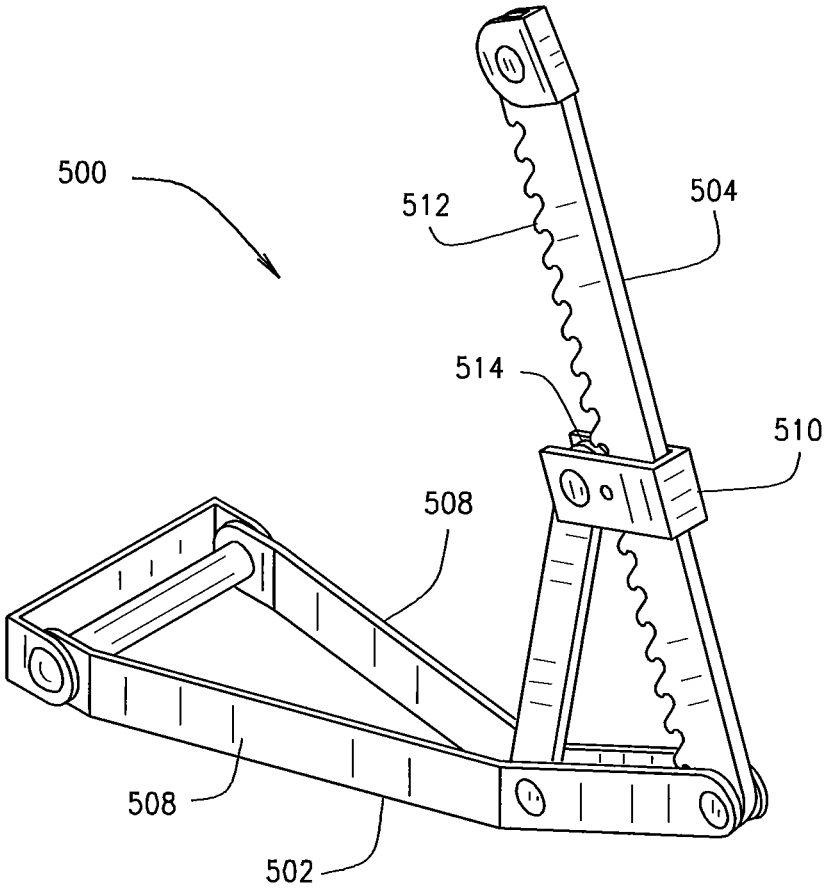
FIG. 16 is a perspective view of an adjustment mechanism for an adjustable platform bed frame according to an embodiment.
Figure 17:
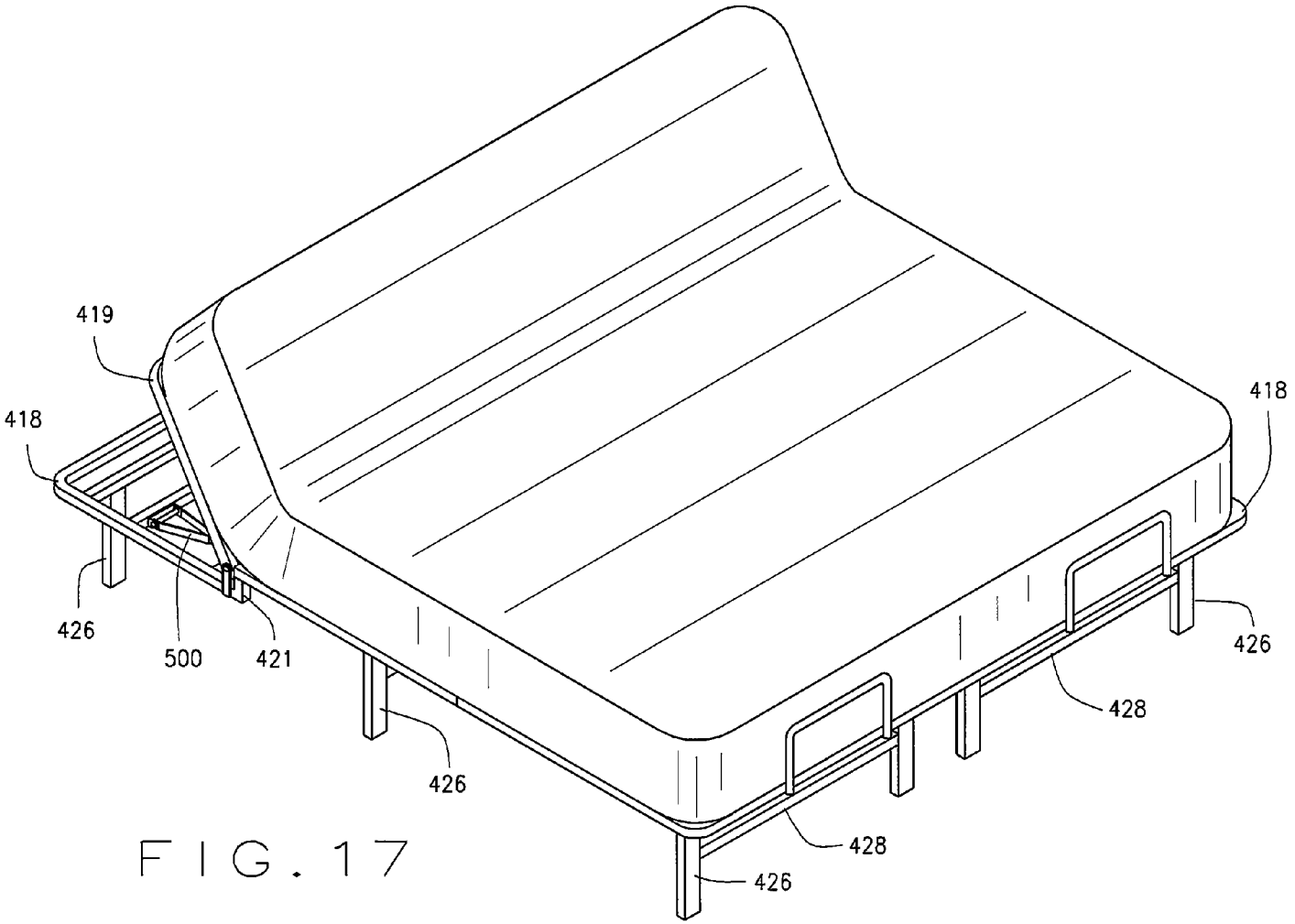
FIG. 17 is a perspective view of a pair of adjustable platform bed frames supporting a mattress in an inclined position.

As best illustrated in FIGS. 12-14, the frame 400 does differ somewhat in its structure from the above embodiments to accommodate the adjustable portion of the frame. In the case of the illustrated embodiment; the adjustable portion is outer frame segment 412, which could be either the head or foot end of the frame. However, it should be recognized that outer frame segment 416 may also be made adjustable—in addition to or in lieu of outer frame segment 412—in the same manner as described below.

More particularly, outer frame segment 412 includes both an outer frame member 418 and an adjustable frame member 419. The outer frame member 418 is connected to the outer frame member 418 of the middle frame segment 414 by a lateral hinge connection 436 having a structure similar to hinge connection 36 in the above embodiments. The lateral hinge connection 436 of the present embodiment differs in that it includes downwardly extending members 421 rigidly attached to either side of the outer frame member of the middle frame segment 414. The downwardly extending members 421 extend approximately two to three inches downward from the level of the outer frame member 418 of the middle frame segment 414 where they each connect to a pivoting hinge 438. The other side of the pivoting hinge 438 is connected with the outer frame member 418 of the outer frame segment 412. As illustrated in the figures, this arrangement places the outer frame member 418 of the outer frame segment 412 at a slightly lower level than the outer frame member 418 of the middle frame segment 414. This arrangement allows room for the adjustable frame segment 419 and, more particularly, allows the adjustable frame segment 419 to lie in the same plane as the outer frame member 418 of the middle frame segment 414 when the adjustable frame segment 419 is lowered to a flat position.

The remaining structures associated with the outer frame member 418 of the outer frame segment 412 are similar to those of the above embodiments, including the incorporation of leg assemblies 424 that are composed of legs 426, a leg assembly support beam 428, and angled support brackets 430. As with the above embodiments, the leg assemblies 424 may be pivotally connected with the outer frame segment 412 by a hinge connection 432. It is necessary to reduce the length of the legs 426 relative to the legs 426 of the non-adjustable frame segments to accommodate the difference in height between the middle frame segment 414 and the outer frame segment 412 while maintaining a level overall structure.

The outer frame member 418 of the outer frame segment 412 is also provided with upwardly extending members 423 on either side at its end adjacent to the middle frame segment 414. The upwardly extending members 423 will have a length equal to that of the downwardly extending members 421 of the middle frame segment 414. The upwardly extending members 423 are rigidly attached at their bottom ends to the outer frame member 418 of the outer frame segment 412. The adjustable frame member 419 is pivotally attached to the top end of each upwardly extending member 423, thereby allowing pivoting movement of the adjustable frame member 419 relative to the outer frame member 418 of the outer frame segment 412.

The adjustable frame member 419 is provided with cross-members 420 for in a similar manner as described in the above embodiments. The adjustable frame member 419 also includes spacers 425 on either side at a location near the end of the adjustable frame member 419 opposite the middle frame segment 414. These spacers 425 have a height that is generally equal to the height of the downwardly 421 and upwardly 423 extending members discussed above and serve to support the end of the adjustable frame member in a level manner when it is placed in a flat position.

Figure 5:
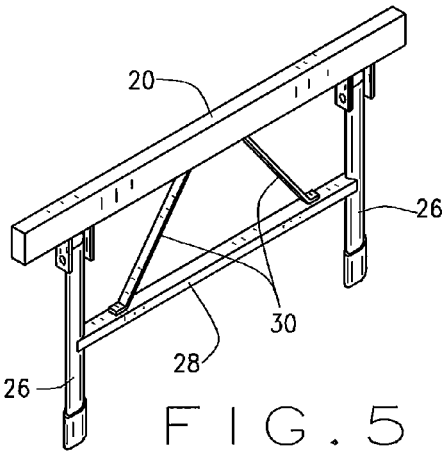
FIG. 5 is a detail view of a leg assembly of the platform bed frame of FIG. 2.
Figure 6:
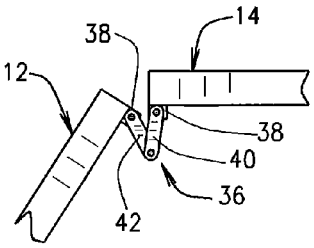
FIG. 6 is a detail view of a frame segment hinge connection of the platform bed frame of FIG. 2.

The adjustable frame member 419 is further connected with the outer frame member by one or more adjustment mechanisms 500, best shown in FIG. 5. While at least two such adjustment mechanisms 500 are utilized in preferred embodiments to enhance the stability of the adjustable frame member 419, it is possible to utilize a single adjustment mechanism 500.

In the illustrated embodiment, the adjustment mechanism 500 includes a base member 502, an adjustment member 504 and a locking member 506 that are pivotally and/or slidably connected with one another. The base member 502 has a first end that is pivotally connected with a cross-member 420 of the outer frame member 418. The second end of the base member 502 is pivotally connected with a first end of the adjustment member 504. The second end of the adjustment member 504 is pivotally connected with a cross-member 420 of the adjustable frame member 419. A first end of the locking member 506 is pivotally connected with the base member 504 at point of the base member 504 intermediate its first and second ends. For additional strength, the base member 502 may include a pair of elongated members 508 between which the ends of the adjustment member 504 and locking member 506 are effectively sandwiched.

The second end of the locking member 506 is connected with the adjustment member 504 in a sliding relationship and forms a ratcheting type mechanism. The second end of the locking member is provided with a flattened collar structure 510 within which the adjustment member 504 is inserted during assembly of the adjustment mechanism 500. The adjustment member 504 fits within the flattened collar structure 510. A portion of the adjustment member 504 is provided with a series of notches 512. The notches 512 preferably face toward the locking member 506. The second end of the locking member 506 also includes a spring-loaded tab or latch 514 that is arranged to fit in the notches 512 of the adjustment member 504. Insertion of the tab 514 into a notch 512 allows the position of the adjustable frame member 419 relative to the outer frame segment 412 to be fixed at a desired angle of inclination. Providing more notches 512 in the adjustment member 504 will result in a greater degree of adjustability of the adjustable frame member 419.

In operation a user lifts the adjustable frame member 419 to a desired degree of inclination. The adjustable frame member 419 is then adjusted further slightly up or down until the tab 514 of the locking member 506 catches the nearest notch 512 of the adjustment member to secure the adjustable frame member 419 in the desired position. The mechanism will "click" when the tab 514 moves into the notch 512, thereby providing positive feedback to confirm that the adjustable frame member 419 is fixed in the desired position. To increase the incline angle of the adjustable frame member 419, the user simply raises the adjustable frame member 419 to until the tab 514 catches the notch 512 nearest the desired position. In order to reduce the incline or place the frame 400 in a flat position, the adjustable frame member 419 is raised until the tab 514 passes the uppermost notch 512. The ratcheting mechanism is then released, which allows the adjustable frame member 419 to be lowered to the desired position.

Advantageously, two frames 400 may be placed next to one another for use with a single larger mattress or two separate mattresses. Clips 200 are used to connect the two frames together. In particular, one or more clips 200 may be used to connect the adjustable frame members 419 of each frame. In doing so, a user can simultaneously adjust both adjustable frame members, which is particularly preferred when the two frames are supporting a single mattress that covers both frames. Alternately, the clip 200 attached to the adjustable frame members 419 may be removed if each frame is supporting a separate mattress to allow for independent adjustment of each side of the bed. In an alternate embodiment, the two frames 400 are bolted together. Matching holes in the frame members are provided through which the bolts are inserted. A washer or tubular spacer, made of rubber in a particularly preferred embodiment to minimize noise associated with the connection, is placed between the frames and the bolt inserted through the spacer. The bolt is secured with a wing nut or other type of nut. As with the clip 200 described above, the bolts connecting the adjustable frame members 419 may be removed to allow independent raising and lowering of the adjustable frame members 419 if two independent mattresses are used rather than a single mattress.

In an alternate embodiment, the flattened collar structure may also be provided with a tightening mechanism, for example a screw, bolt, thumbscrew or similar device, to squeeze the sides of the collar structure 510 together with the adjustment member 504 in between, thereby securing the locking member 506 and adjustment member 504 in the desired relative position. In order to adjust the adjustable frame member 419 to a different angle or to put it in a flat position, the tightening mechanism is released, which allows the locking member 506 to move relative to the adjustment member 504 and the adjustable frame member to be lowered or raised.

While a preferred example of an adjustment mechanism 500 has been described, it should be appreciated that other mechanisms may be utilized and are considered to be within the scope of the invention.

The adjustable embodiments described above maintain a relatively lightweight frame that may be shipped (for example by UPS or FedEx) and installed by a user. These embodiments are easy and intuitive to operate and require little, if any, maintenance due to their streamlined mechanical operation. Further, these embodiments can be utilized with a user's existing bed system—headboard, foot board and side rails—such that the user can keep their current bed system yet add adjustability. Additionally, an adjustable section for the leg portion of the platform frame may also be incorporated in addition an adjustable head section. This would allow the user to incline the head portion and/or leg portion independently or simultaneously.

Figure 18:
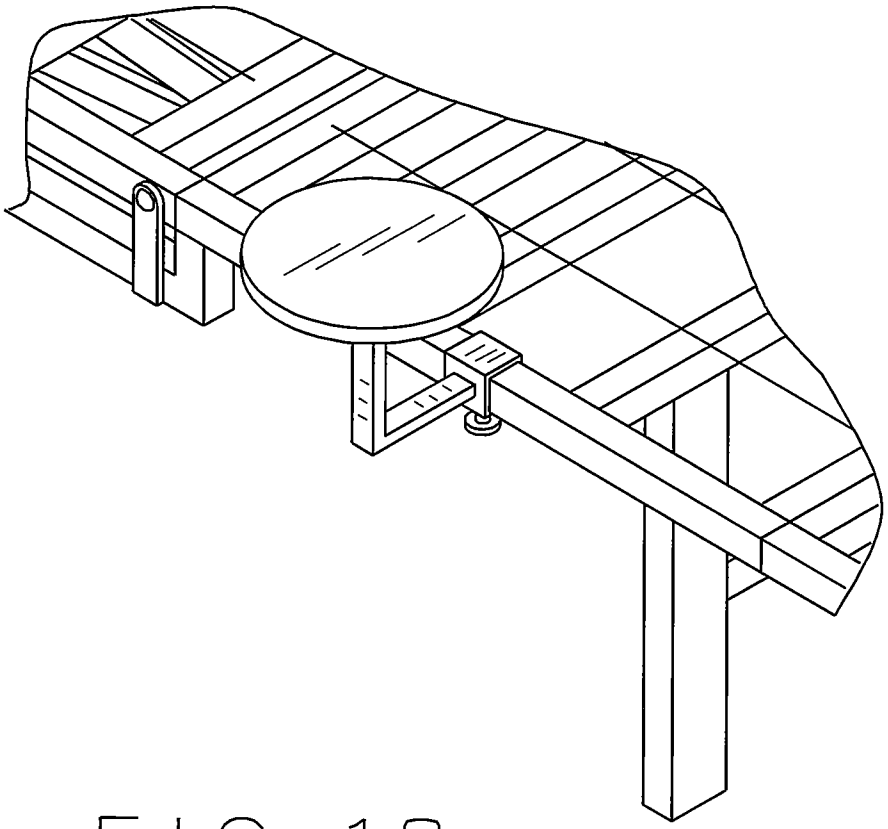
FIG. 18 is a view of a night table attachment for a platform bed frame.

The platform frames described above are also particularly well suited to a night table attachment 600 as shown in FIG. 18. The night table attachment includes a table top 602 supported by an arm 604. The arm 604 is connected to a clamp 606 that attaches to the outer frame member 18, 418. The clamp 606 is a "C" clamp in the illustrated embodiment, and is secured to the outer frame member 18, 418 by a bolt 608. The design of the clamp 606 allows it to be loosened—by loosening the bolt 608—and slid along the outer frame member 18, 418 to the desired position. This is particularly advantageous in the case of adjustable frame 400 in that the night table can be easily moved forward on the frame when the adjustable frame member 419 is placed in an inclined position, which moves the occupant's upper body forward in the bed.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiments, but should be defined only in accordance with the following claims appended hereto and their equivalents.

What is claimed is:

1. An adjustable platform bed frame, comprising:

first and second frame segments, wherein each frame segment comprises an outer frame member and a plurality of cross-members, said first frame segment positioned at a height that is slightly lower than that of said second frame segment;

a first adjustable frame member pivotally connected with said first frame segment and arranged in a plane above and parallel to a plane in which said first frame segment lies when both said first frame segment and said first adjustable frame member are in a flat position; and at least a first adjustment mechanism connected at a first end with said first frame segment and at a second end with said first adjustable frame member, said first adjustment mechanism operable for temporarily fixing said first adjustable frame member in an inclined position relative to said second frame segment.

2. The adjustable platform bed frame of claim 1, further comprising:

a third frame segment connected to said second frame segment, said second frame segment positioned between said first and third frame segments, said third frame segment positioned at a height that is slightly lower than that of said second frame segment;

a second adjustable frame member pivotally connected with said third frame segment and arranged above said third frame segment; and a second adjustment mechanism connected at a first end with said third frame segment and at a second end with said second adjustable frame member, said second adjustment mechanism operable for temporarily fixing said second adjustable frame member in an inclined position relative to said second frame segment.

3. The adjustable platform bed frame of claim 2, further comprising:

a first lateral hinge connection connecting said first and second frame segments;

a second lateral hinge connection connecting said second and third frame segments;

at least first and second leg assemblies connected to said first and third frame segments, respectively; and wherein said first and second lateral hinge connections are parallel to a midline of said bed frame with said first lateral hinge connection located to one side of said midline and said second lateral hinge connection located to the other side of said midline.

4. The adjustable platform bed frame as set forth in claim 3, wherein said first, second, and third frame segments are of approximately equal size.

5. The adjustable platform bed frame as set forth in claim 3, wherein said first and second lateral hinge connections are parallel to said midline.

6. The adjustable platform bed frame as set forth in claim 3, further comprising:

a first leg hinge connection connecting said first leg assembly to said first frame segment; and a second leg hinge connection connecting said second leg assembly to said third frame segment.

7. The adjustable platform bed frame as set forth in claim 3, further comprising a third leg assembly connected to said second frame segment.

8. The adjustable platform bed frame as set forth in claim 3, further comprising at least one fastener to secure a second, identical platform bed frame next to said platform bed frame.

9. The adjustable platform bed frame as set forth in claim 3, further comprising a second, identical platform bed frame placed next to said platform bed frame.

10. The adjustable platform bed frame of claim 1, wherein said first adjustment mechanism comprises:

a base member pivotally connected at a first end thereof with said first frame segment;

an adjustment member pivotally connected at a first end thereof with said first adjustable frame member, a second end of said adjustment member being pivotally connected with a second end of said base member, said adjustment member have a series of notches arranged along a portion of its length;

a locking member pivotally connected at a first end thereof to said base member at a point between said first and second ends of said base member, said locking member slidingly connected with said adjustment member at a point between said first and second ends of said adjustment member, said locking member having at its second end a tab for releasable engagement with one of said notches.

11. The adjustable platform bed frame as set forth in claim 1, further comprising a night table attachment, said night table attachment comprising a table surface, a supporting arm connected to said table surface, and a clamp connected with said supporting arm, said clamp having an open cross-section allowing said clamp to fit around said outer frame member and slide along said outer frame member to a desired position.

12. An adjustable platform bed frame, comprising:

first and second outer frame segments and an inner frame segment, said inner frame segment positioned between said first and second outer frame segments, said first and second outer frame segments hingedly connected with said inner frame segment;

at least first and second leg assemblies connected to said first and second outer frame segments, respectively; and an adjustable frame member pivotally connected with said first outer frame segment and arranged in a plane above and parallel to said a plane in which the first outer frame segment lies when both said first outer frame segment and said adjustable frame member are in a flat position; and an adjustment mechanism connected at a first end with said first outer frame segment and at a second end with said adjustable frame member, said first adjustment mechanism operable for temporarily fixing said adjustable frame member in an inclined position relative to said inner frame segment.

13. The adjustable platform bed frame of claim 12, wherein said adjustment mechanism comprises:

a base member pivotally connected at a first end thereof with said first outer frame segment;

an adjustment member pivotally connected at a first end thereof with said adjustable frame member, a second end of said adjustment member being pivotally connected with a second end of said base member, said adjustment member have a series of notches arranged along a portion of its length;

a locking member pivotally connected at a first end thereof to said base member at a point between said first and second ends of said base member, said locking member slidingly connected with said adjustment member at a point between said first and second ends of said adjustment member, said locking member having at its second end a tab for releasable engagement with one of said notches.

14. The adjustable platform bed frame as set forth in claim 12, wherein said first and second outer frame segments and said inner frame segment are of approximately equal size.

15. The adjustable platform bed frame as set forth in claim 12, wherein said inner frame segment is longer than each of said first and second outer frame segments.

16. The adjustable platform bed frame as set forth in claim 12, wherein said leg assemblies each further comprise at least first and second legs and a support beam therebetween and connected to said legs.

17. The adjustable platform bed frame as set forth in claim 12, further comprising:

a first leg hinge connection connecting said first leg assembly to said first outer frame segment; and a second leg hinge connection connecting said second leg assembly to said second outer frame segment.

18. The adjustable platform bed frame as set forth in claim 12, further comprising a third leg assembly connected to said inner frame segment.

19. The adjustable platform bed frame as set forth in claim 18, further comprising a third leg hinge connection connecting said third leg assembly to said inner frame segment.

20. A method of supporting a mattress with an adjustable platform bed frame, comprising the steps of:

providing an adjustable platform bed frame comprising:

first and second frame segments, wherein each frame segment comprises an outer frame member and a plurality of cross-members, said first frame segment positioned at a height that is slightly lower than that of said second frame segment;

a first adjustable frame member pivotally connected with said first frame segment and arranged in a plane above and parallel to said a plane in which the first frame segment lies when both said first frame segment and said first adjustable frame member are in a flat position; and at least first adjustment mechanism connected at a first end with said first frame segment and at a second end with said first adjustable frame member, said first adjustment mechanism operable for temporarily fixing said first adjustable frame member in an inclined position relative to said first frame segment;

placing a mattress on said first and second frame segments; and raising said first adjustable frame member to a desired incline level relative to said second frame segment.

* * * * *